US005272023A

United States Patent [19]

Yamamoto et al.

[11] Patent Number: 5,272,023

[45] Date of Patent: Dec. 21, 1993

[54] HOTMELT-ADHESIVE FIBER SHEET AND PROCESS FOR PRODUCING THE SAME

[75] Inventors: Kazue Yamamoto, Yokaichi; Satoshi Ogata, Moriyama, both of Japan

[73] Assignee: Chisso Corporation, Ohsaka, Japan

[21] Appl. No.: 17,627

[22] Filed: Feb. 12, 1993

[30] Foreign Application Priority Data

Feb. 18, 1992 [JP] Japan ..... 4-068995

[51] Int. Cl.[5] ..... B32B 27/14

[52] U.S. Cl. ..... 428/198; 156/167; 156/290; 156/308.2; 428/224; 428/288; 428/296; 428/373; 428/903

[58] Field of Search ..... 156/167, 290, 308.2; 428/198, 224, 288, 296, 373, 903

[56] References Cited

U.S. PATENT DOCUMENTS

| | | | |
|---|---|---|---|
| 4,381,335 | 4/1983 | Okamoto | 428/373 |
| 5,100,435 | 3/1992 | Omwumere | 428/373 |
| 5,124,194 | 6/1992 | Kawano | 428/373 |
| 5,219,647 | 6/1993 | Vock et al. | 428/373 |

*Primary Examiner*—James J. Bell

*Attorney, Agent, or Firm*—Fay, Sharpe, Beall, Fagan, Minnich & McKee

[57] ABSTRACT

A hotmelt-adhesive fiber sheet having a superior adhesion and sheet-form retainability is provided, which sheet is composed of substantially unstretched fibers of an average fiber diameter of 10 μm or less composed of an olefinic copolymer or terpolymer composed mainly of propylene, the fiber contact points of the fiber sheet being hotmelt-adhered.

4 Claims, No Drawings

HOTMELT-ADHESIVE FIBER SHEET AND PROCESS FOR PRODUCING THE SAME

BACKGROUND OF THE INVENTION

1. Field of the Invention

This invention relates to a hotmelt-adhesive fiber sheet having a superior adhesion and a good sheet-form retainability and a process for producing the sheet.

2. Description of the Related Art

Heretofore, as a sheet made of hotmelt-adhesive fibers, there have been known those obtained by conjugate-spinning polypropylene as a high melting point component and polyethylene or ethylenevinyl acetate copolymer as a low melting point component, followed by heat-treating a resulting web, thereby fixing the contact points of the fibers with each other by hotmelt-adhesion of the low melting component (Japanese patent publication No. Sho 54-44773).

Further, Japanese patent publication No. Sho 55-26203 discloses that a blend of a crystalline copolymer (propylene-butene-ethylene terpolymer) with a substantially non-crystalline ethylene-propylene random copolymer is used for regular fibers or for a low melting component of conjugate fibers, thereby improving the spinnability of a polypropylene having a low hotmelt-adhesive temperature.

However, the above prior art has raised the following drawbacks.

Since the fibers are obtained by conventional melt-spinning process, the fiber diameter is relatively large and it is difficult to obtain particularly fine fibers of 10 μm or less. An oiling agent such as lubricant, etc. is required at the spinning and stretching steps, and the retainability of the sheet form is inferior, etc.

In particular, the oiling agent such as lubricant, antistatic agent, etc. used at the conventional spinning and stretching steps is indispensable at the respective steps of taking-up, cutting, secondary processing, etc., but it is economically difficult to put a post-treatment to remove the agent. Thus, there has been raised a problem that the agent remained in the final product of the fibers depress the adhesion property of the resins constituting the fibers, at the time of hotmelt-adhesion.

SUMMARY OF THE INVENTION

The present inventors have made extensive researches in order to solve the above-mentioned problems. As a result, we have found that when a sheet composed of fibers having an average fiber diameter of 10 μm or less, composed of an olefinic copolymer or terpolymer composed mainly of propylene as the whole component of the fiber or as a conjugate component of the fibers is produced by a melt-blown process, the object of the present invention can be achieved.

The present invention provides a hotmelt-adhesive fiber sheet which is composed of substantially unstretched fibers of an average fiber diameter of 10 μm or less composed of an olefinic copolymer or terpolymer composed mainly of propylene, said olefinic copolymer being at least one of a copolymer consisting of 99 to 85% by weight of propylene, and 1 to 15% by weight of ethylene and a copolymer consisting of 99 to 50% by weight of propylene and 1 to 50% by weight of butene-1, and said terpolymer being a terpolymer consisting of 84 to 97% by weight of propylene, 1 to 10% by weight of ethylene and 1 to 15% by weight of butene-1; and the fiber contact points in the fiber sheet is hotmelt-adhered.

The present invention also provides a process for producing a hotmelt-adhesive fiber sheet, which process comprises the steps of;

feeding melted olefinic copolymer or terpolymer composed mainly of propylene into a spinneret having spinning nozzles, said copolymer being at least one of a copolymer consisting of 99 to 85% by weight of propylene and 1 to 15% by weight of ethylene and a copolymer consisting of 99 to 50% by weight of propylene and 1 to 50% by weight of butene-1, and said terpolymer being a terpolymer consisting of 84 to 97% by weight of propylene, 1 to 10% by weight of ethylene and 1 to 15% by weight of butene-1;

extruding and blowing said melted copolymer or terpolymer from said spinning nozzles, and then stacking the resulting fibers in the form of a sheet on a collecting conveyer, said sheet being composed of substantially unstretched fibers of an average fiber diameter of 10 μm or less, and is hotmelt-adhered at the fiber contact points.

DETAILED DESCRIPTION OF PREFERRED EMBODIMENTS

The present invention will be described in more detail.

The olefinic copolymer composed mainly of propylene referred to in the present invention means a random copolymer composed of 99 to 85% by weight of propylene and 1 to 15% by weight of ethylene or a random copolymer composed of 99 to 50% by weight of propylene and 1 to 50% by weight of butene-1. Further, the olefinic terpolymer composed mainly of propylene referred to herein means a random copolymer composed of 84 to 97% by weight of propylene, 1 to 10% by weight of ethylene and 1 to 15% by weight of butene-1.

The above olefinic copolymer or terpolymer composed mainly of propylene is a solid polymer obtained by polymerizing propylene and ethylene or propylene, ethylene and butene-1 using a Ziegler-Natta catalyst so as to afford the above-mentioned component contents of propylene and ethylene or propylene, ethylene and butene-1, and it is substantially a random copolymer. As a polymerizing method, besides a process of polymerizing mixed monomer gases from the beginning, a two-step process that a polymer of 20% or less by weight based upon the total polymer weight is obtained by propylene homopolymerization, and then mixed monomer gases of the respective components are polymerized, may be adopted.

If the content of the comonomer (ethylene or butene-1) in the copolymer is less than 1%, the hotmelt-adhesion of the resulting fibers is insufficient. The ethylene content has a large influence upon the melting point and the butene-1 content has a large influence upon both the melting point and the hotmelt-adhesion.

On the other hand, with increase in the comonomer content, the melting point of the copolymer lowers and the hotmelt-adhesion increases, but at the same time, the proportion of by-product which is soluble in a polymerization solvent (hydrocarbon) at the time of polymerization increases, thereby lowering the productivity of copolymers.

The hotmelt-adhesive fiber sheet of the present invention may be composed of uniform fibers consisting of one component selected from those copolymers and terpolymers, and also may be composed of conjugate fibers in which at least a portion of the fiber surface is formed by a conjugate component selected from those copolymers and terpolymers.

Examples of the other components comprising the conjugate fibers together with the olefinic copolymer or terpolymer composed mainly of propylene are thermoplastic resins such as polyamides, polyesters, low melting copolymerized polyesters, polyvinylidene chloride, polyvinyl acetate, polystyrene, polyurethane elastomer, polyester elastomer, polypropylene, polyethylene, copolymerized polypropylene, etc. Among those resins, polypropylene resins which are heat-degradable are preferred, since the resins are easy to make the fibers finer and are hard to peel off from the olefinic copolymer or terpolymer composed mainly of propylene. Further, in the case of this combination of resins, since the whole components of the sheet are composed of polyolefin raisins, the product has a high chemical resistance and a high utilization value.

As to the hotmelt-adhesive fiber sheet of the present invention, since the composed fibers have an average fiber diameter of 10 μm or less, an anchor effect is liable to occur at the points of adhesion between the sheets each other or between the sheet and another material to be adhered. The average fiber diameter referred to herein means a value obtained by taking a photograph of fibers with 100 to 5,000 magnifications by means of a scanning-type electronic microscope, measuring the fiber diameter at 100 positions on the resulting photograph and calculating the average value of them. The fibers having an average fiber diameter of 10 μm or less can be obtained according to a melt-blown spinning process. The fibers are composed of substantially unstretched fibers having a limited fiber length.

If the average fiber diameter exceeds 10 μm, the contact area of the fibers with an objective material at the time of adhesion is reduced along with the reduction in the fiber surface area. Thus, the heat quantity required for the adhesion becomes larger and the anchor effect to the objective material will not be expected. In short, the finer the fiber diameter of the fibers constituting the sheet, the more the surface area of the fibers increases. Further, when the fiber diameter becomes small, the fibers are easily folded in a small curvature radius. As a result, since the contact area becomes larger, the adhesion of the fibers to the objective material is improved. Further, at the same time, since the contact area of the fibers with each other becomes greater and the number of contact points increase, the network of the fibers is reinforced along with the increase in the hotmelt-adhesive area, thereby the shape-retainability of the sheet being improved.

The fibers constituting the hotmelt-adhesive fiber sheet of the present invention having an average fiber diameter of 10 μm or less can be obtained by spinning the above olefinic copolymer or terpolymer composed mainly of propylene, according to a melt-blown process. Further, in the case of conjugate fibers using another thermoplastic resin component as described above, the conjugate fibers can be obtained by conjugate-spinning according to a melt-blown process.

A melt-blown process for conjugate fibers can be carried out by feeding two kinds of thermoplastic resins each independently melted, into a spinneret, combining them, blowing the resin extruded from spinning nozzles by a high temperature and a high speed gas, and stacking the resulting fibers in the form of a sheet or a web onto a collecting conveyer. Further, as to a known melt-blown process for producing conjugate fibers, Japanese patent application laid-open No. Sho 60-99057 is referred to.

As for a conjugate form, either one of side-by-side type or sheath-and-core type may be employed depending on the required final applications. As a blowing gas, air or nitrogen gas of about 1 to 2 kg/cm$^2$.G and at about 300° to 400° C. is employed. The gas is ejected at a speed of 350 to 500 m/sec at the exit of the spinneret. The distance between the spinneret and the collecting conveyer may be adjusted usually within a range of 30 to 80 cm, but particularly a distance of 50 to 70 cm is preferred to obtain a good dispersibility.

The conjugate ratio of the above olefinic copolymer or terpolymer composed mainly of propylene to another thermoplastic resin is in the range of 30/70 to 70/30, preferably 40/60 to 60/40, more preferably 45/55 to 55/45. If the conjugate ratio is less than 30/70, the hotmelt-adhesion of the resulting fibers lowers, while if the ratio exceeds 70/30, the melt viscosity difference of the conjugate components in the fiber direction is difficult to control causing an extrusion unevenness.

The melting point of the olefinic copolymer or terpolymer composed mainly of propylene is 110° to 150° C., but the polymers having a melting point of 125° to 138° C. and a melt flow rate at 230° C. of 50 to 150 g/10 min are preferred in the aspect of spinnability. Further, in the case of conjugate spinning, as another high melting resin to be combined with the copolymers, those having a melting point of 20° C. or higher than that of the copolymers are preferred, since the thermal processing of the resulting conjugate fiber sheet becomes easy. However, when the softening, fusion, etc. of the high melting point component cause no-problem upon the final applications, the above melting point has no particular limitation.

The melt flow rate referred to herein is measured according to ASTM D-1238 (D), and the melt index referred to herein is measured according to ASTM D-1238 (E). Further, the melting point referred to herein is generally measured by means of a differential scanning calorimeter (DSC) as an endothermic peak. In the case of non-crystalline, low melting point, copolymerized polyesters or the like, where the melting point is not always clearly exhibited, it is substituted by the so-called softening point which is measured by differential thermal analysis (DTA) or the like.

The hotmelt-adhesive fiber sheet of the present invention is characterized in that the contact points of the fibers constituting the sheet are hotmelt-adhered with each other. Such a hotmelt-adhesive fiber sheet is usually obtained by a single step process stacking melt blown spun fibers on a collecting conveyer as described above. However, depending upon spinning conditions, the sheet is produced by two-step process restricting the hotmelt-adhesion of the fibers to each other on the conveyer to the minimum, and then adapting a secondary processing such as heat embossing rolls, heat-calendering rolls, far infrared rays heating, ultrasonic welding, air-through heating, etc. Making use of the secondary processing, the sheet can be also utilized as a material for molded products. Further, depending upon its use applications, the sheet obtained by the above single step can be processed by heat-embossing rolls or heat-calendering rolls, thereby obtaining a homogeneous sheet having few thickness variation. When the thickness is desired to be large, or the feeling is desired to be soft, heat treatment by airthrough (e.g. 135° C., 1.9 m/sec, 10 seconds) is preferred. Further, when the fiber form of the hotmelt-adhesive fiber sheet is a conjugate fiber, it is possible to control the percentage of shrinkage by the heat-treatment conditions. This is one of the specific features of the sheet of the present invention.

Further, an important specific feature of the hotmelt-adhesive fiber sheet of the present invention consists in that when the fiber form is a conjugate fiber, even if the conjugate fiber sheet has a similar resin composition, the sheet can be composed of far thinner fibers than those obtained by a conventional spinning method, whereby the heat shrinkage is notably reduced. In order to exhibit such specific properties, it is desired that the proportion of the hotmelt-adhesion of fibers to each other is large, but even if it is small, the contact points of fibers with each other increase due to the fine fibers produced by a melt-blown process. Thus, there is a tendency that the shrinkage is restrained as the frictional force of the fibers with each other is increased, thereby the shape-retainability of the sheet is notably improved.

The present invention will be described in more detail by way of Examples and Comparative examples.

In the examples, the tests of the peel strength, the percentage of shrinkage of the sheet and the adhesion strength to another objective material were carried out as follows:

Peel strength

A sample sheet (50 g/m$^2$) was cut so as to give 5 cm width, followed by superposing two pieces, adhering them (130° C., 3 kg, 3 sec., adhered area: 1 cm×5 cm) by means of a heat sealer and measuring the peel strength by means of a tensile tester (n=5).

Percentage of shrinkage of sheet

A sample sheet (50 g/m$^2$) was cut so as to give 25×25 cm square, followed by placing the resulting piece on a Teflon (Trademark) sheet, placing the resulting sheet in the middle stage of a circulating type oven at 125° C. in the case where the fiber is non-conjugate type, or at 145° C. in the case where the fiber is conjugate type, heat-treating the sheet for 5 minutes, allowing it to cool, measuring the lengths of the piece at the respective five portions in the longitudinal direction and in the lateral direction, averaging the lengths to present the percentage of shrinkage of the sheet in terms of percentage of the lengths of the original sheet in the longitudinal direction and in the lateral direction (n=3).

Adhesion strength to another objective material

Kraft paper, cotton cloth and PET (polyethylene terephthalate) woven-cloth were respectively cut so as to give a sheet of 5 cm width, followed by superposing the resulting two sheets, placing a test piece (50 g/m$^2$) between the sheets, adhering them in such a state by means of a heat sealer under specific conditions (Kraft paper: 140° C., 3 kg, 10 seconds; cotton cloth: 140° C., 3 kg, 30 seconds; PET woven-cloth: 140° C., 3 kg, 30 seconds; adhesion area: 1 cm×5 cm), and measuring the respective adhesion strengths by means of a tensile tester (n=5).

The following various kinds of raw materials were used in the Examples and the Comparative examples. The composition ratios were all based upon % by weight (hereinafter abbreviated to %):

(Examples 1–6)

COPP-1: propylene-ethylene copolymer (ethylene 11.5%, melt flow rate 75, m.p. 128° C.)

COPP-2: propylene-butene-1 copolymer (butene-1 20.1%, melt flow rate 72, m.p. 130° C.)

COPP-3: propylene-ethylene-butene-1 terpolymer (ethylene 3.8%, butene-1 4.5%, melt flow rate 6.6, m.p. 130° C.)

PP-1: polypropylene (melt flow rate 88, m.p. 166° C.) (Comparative example 1)

COPP-4 propylene-ethylene-butene-1 terpolymer (ethylene 12.7%, butene-1 2.2%, melt flow rate 37.1, m.p. 130° C.)

PP-2: polypropylene (melt flow rate 6.2, m.p. 163° C.) (Comparative example 2)

EV-1: EVA (ethylene-vinyl acetate copolymer)/high density polyethylene=50/50 (EVA: vinyl acetate 28.0%, melt index 15, high density polyethylene: melt index 25, m.p. 129° C.)

PP-3: polypropylene (melt flow rate 9.6, m.p. 165° C.)

Example 1

Using a spinneret for melt blow wherein 501 spinning nozzles each having holes of 0.3 mm diameter were arranged in one row, COPP-1 was fed at a spinning temperature of 240° C. and in an extrusion quantity of 120 g/min, followed by blowing the polymer extruded from the spinning nozzles onto a collecting conveyer by air at 400° C. and under 1.0 kg/cm$^2$.G. As the collecting conveyer, a polyester net conveyer provided at a distance of 70 cm from the spinneret and moving at a speed of 4 m/min was used, and the blown air was removed by a suction means provided at the back side of the conveyer.

The production conditions of the sheet, the average diameter of the fibers constituting the sheet, the peel strength, percentage of heat shrinkage, and adhesion strength to another objective material of the sheet are shown in Table 1-1 and Table 1-2.

Examples 2 and 3

Example 1 was repeated except that COPP-1 was replaced by COPP-2 or COPP-3, to obtain various kinds of sheets. The production conditions of these sheets, average diameters of the fibers constituting the sheets, the peel strengths, percentages of heat shrinkage and adhesion strengths to another objective material of the resulting sheets are also shown in Table 1-1 and Table 1-2.

Example 4

Using a spinneret for sheath-and-core type conjugate melt blow spinning, wherein 501 spinning nozzles each having holes of 0.3 mm diameter were arranged in one row, COPP-1 as the first component (spinning temperature: 240° C.) and PP-1 as the second component (spinning temperature: 200° C.) were fed in a conjugate ratio of 50/50 and in a total quantity of extrusion of 120 g/min, followed by blowing the resulting polymer extruded from the spinning nozzles onto a collecting conveyer by air at 400° C. and under 1.0 kg/cm$^2$.G. As the collecting conveyer, a polyester net conveyer provided at a distance of 50 to 70 cm from the spinneret and moving at a speed of 4 m/min was used, and blown air was removed by a suction means provided at the back side of the conveyer.

The production conditions of this sheet, the average diameter of the fibers constituting it, the peel strength, percentage of heat shrinkage and adhesion strength to another objective material of the resulting sheet are also shown in Table 1-1 and Table 1-2.

Examples 5 and 6

Example 4 was repeated except that COPP-1 was replaced by COPP-2 or COPP-3 and the sheath-and-core type spinneret was replaced by that of side-by-side type, to obtain the respective kinds of sheets. The production conditions of these sheets, the average diameters of the fibers constituting them, the peel strengths, percentages of heat shrinkage and adhesion strengths to another objective material of the resulting sheets are also shown in Table 1-1 and Table 1-2.

Comparative example 1

Using COPP-4 and PP-2 as raw materials and according to a conventional conjugate spinning process in place of a melt blown process of Examples 4 to 6, stretched yarns were obtained, followed by imparting about 10 crimps per 25 mm to the yarns by a crimper, cutting the yarns into staples having a fiber length of 64 mm, forming a web of 50 g/m$^2$ through a carding machine and hotmelt-adhering the web by the medium of the low melting point component through an air-through processing machine, to obtain a non-woven cloth.

The average diameter of the fibers constituting the sheet, the peel strength, percentage of heat shrinkage and adhesion strength to another objective material of the sheet are shown in Table 1-1 and Table 1-2.

Comparative example 2

Conjugate spinning was carried out using EV-1 and PP-3 in place of the raw materials of comparative example 1, followed by imparting crimps similar to those in Comparative example 1 onto the stretched yarns obtained above, passing the resulting web through a carding machine and obtaining a non-woven cloth by means of an air-through processing machine.

The average diameter of the fibers constituting the sheet, the peel strength, percentage of heat shrinkage and adhesion strength to another objective material of the resulting sheet are shown in Table 1-1 and Table 1-2.

TABLE 1-1

| Examples and Comparative examples | Melt-blown process | Fiber-form | Resin | Composition ratio (wt. %) Ethylene | Butene-1 |
|---|---|---|---|---|---|
| Example 1 | | Non-conjugate | COPP-1 | 11.5 | — |
| Example 2 | | Non-conjugate | COPP-2 | — | 20.1 |
| Example 3 | | Non-conjugate | COPP-3 | 3.8 | 4.5 |
| Example 4 | | Conjugate | COPP-1 | 11.5 | — |
| | | | PP-1 | — | — |
| Example 5 | | Conjugate | COPP-2 | — | 20.1 |
| | | | PP-1 | — | — |
| Example 6 | | Conjugate | COPP-3 | 3.8 | 4.5 |
| | | | PP-1 | — | — |
| Comp. ex. 1 | | Conjugate | COPP-4 | 12.7 | 2.2 |
| | | | PP-2 | — | — |
| Comp. ex. 2 | | Conjugate | EV-1 | (Note 1) | |
| | | | PP-3 | — | — |

Comp. ex. 1: Japanese patent publication No. Sho 55-26203
Comp. ex. 2: Japanese patent publication No. Sho 54-44773
Note 1: EVA/HDPE = 50/50

TABLE 1-2

| Examples and Comparative examples | Effect: Sheet/sheet peel strength kg/5 cm | % of shrinkage (%) of sheet | Adhesion strength to other objective material (Note 2): Kraft paper | Cotto cloth | PET cloth | Average diameter of fibers (μm) |
|---|---|---|---|---|---|---|
| Example 1 | *1.68< | 1.7 | 1.10 | 3.25 | 0.52 | 2.1 |
| Example 2 | *1.87< | 1.9 | *1.67< | 3.60 | 0.98 | 2.1 |
| Example 3 | *1.99< | 2.8 | *1.63< | 4.02 | 1.02 | 2.1 |
| Example 4 | *1.36< | 1.2 | 0.87 | 1.57 | 0.24 | 1.5 |
| Example 5 | *1.44< | 1.1 | *1.21< | 1.85 | 0.33 | 1.5 |
| Example 6 | *1.49< | 1.5 | *1.24< | 1.96 | 0.20 | 1.5 |
| Comp. ex. 1 | 0.48 | 75 | Non-adhered | 0.05 | Non-adhered | 10.8 |
| Comp. ex. 2 | 0.62 | 48 | 0.53 | 0.49 | Non-adhered | 21.6 |

(Note 2) Unit: kg/5 cm
(Note 3) *shows that the adhesion strength was so high that breakage occurred.
(Note 4) "Non-adhered" shows a non-adhered state because of little adhesion strength.

As to the advantageous effects of the hotmelt-adhesive fiber sheet of the present invention, since an olefinic copolymer or terpolymer composed mainly of propylene which is heat-degradable, is subjected to a melt blown spinning process and constitutes a main component of the fibers in the sheet, it is possible to make the fibers finer, and at the same time, it is possible to increase the degree of freedom of the fibers in the sheet, the adhesion strength and the surface area of the fibers, so that the hotmelt-adhesion of the sheet is improved. Further, due to the anchor effect of the fibers to a material to be adhered, brought about by the finer fiber diameter, it is possible to realize stronger adhesion than expected from affinity or compatibility of the resin constituting the fiber sheet with the material to be adhered. The fiber sheet of the present invention is useful as a hotmelt-adhesive, and also, in the case that the sheet composite fiber products, the fiber sheet itself can be utilized as a material for the foamed products. And yet, since the hotmelt-adhesive sheet is obtained according to a melt-blown process, it is possible to prevent reduction in the hotmelt-adhesion capability due to lubricant, etc. so far added at the time of conventional spinning and stretching steps, and also it is possible to exhibit and utilize the intrinsic adhesion properties of the resin constituting the fibers.

What we claim is:

1. A hotmelt-adhesive fiber sheet which is composed of substantially unstretched fibers of an average fiber diameter of 10 μm or less composed of an olefinic copolymer or terpolymer composed mainly of propylene, said olefinic copolymer being at least one of a copolymer consisting of 99 to 85% by weight of propylene and 1 to 15% by weight of ethylene, and a copolymer consisting of 99 to 50% by weight of propylene and 1 to 50% by weight of butene-1, and said terpolymer being a terpolymer consisting of 84 to 97% by weight of propylene, 1 to 10% by weight of ethylene and 1 to 15% by weight of butene-1; and the fiber contact points in said fiber sheet is hotmelt-adhered.

2. A hotmelt-adhesive fiber sheet according to claim 1, wherein said fiber is a conjugate fiber which is composed of a higher melting point component and a lower melting point component, the temperature difference between the melting points of the components being 20° C. or more.

3. A process for producing a hotmelt-adhesive fiber sheet, which process comprises the steps of;

feeding melted olefinic copolymer or terpolymer composed mainly of propylene into a spinneret having spinning nozzles, said copolymer being at least one of a copolymer consisting of 99 to 85% by weight of propylene and 1 to 15% by weight of ethylene and a copolymer consisting of 99 to 50% by weight of propylene and 1 to 50% by weight of butene-1, and said terpolymer being a terpolymer consisting of 84 to 97% by weight of propylene, 1 to 10% by weight of ethylene and 1 to 15% by weight of butene-1;

extruding and blowing said melted copolymer or terpolymer from said spinning nozzles, and then stacking the resulting fibers in the form of a sheet on a collecting conveyer, said sheet being composed of substantially unstretched fibers of an average fiber diameter of 10 μm or less, and is hotmelt-adhered in the fiber contact points.

4. A process for producing a hotmelt-adhesive fiber sheet according to claim 1, wherein said spinneret is a spinneret for conjugate spinning, and at least two kinds of said olefinic copolymer or terpolymer having a melting points difference of 20° C. or more are subjected to conjugate spinning.

* * * * *